US007091431B1

(12) United States Patent
Arcand et al.

(10) Patent No.: US 7,091,431 B1
(45) Date of Patent: Aug. 15, 2006

(54) DISCONNECT SWITCH

(75) Inventors: Sébastien Arcand, St-Augustin-de-desmaures (CA); Sébastien Cote, Pont-Rouge (CA)

(73) Assignee: General Electric Canada, Mississauga (CA)

( * ) Notice: Subject to any disclaimer, the term of this patent is extended or adjusted under 35 U.S.C. 154(b) by 0 days.

(21) Appl. No.: 11/122,078

(22) Filed: May 5, 2005

(30) Foreign Application Priority Data

Feb. 8, 2005 (CA) ..... 2496250

(51) Int. Cl.
*H01H 31/02* (2006.01)

(52) U.S. Cl. ..... 200/48 R; 218/14

(58) Field of Classification Search ..... 200/48 R, 200/48 A, 48 P, 48 KB, 48 CB, 48 SB; 218/2, 218/7, 9, 14, 20, 45, 80, 152–154
See application file for complete search history.

(56) References Cited

U.S. PATENT DOCUMENTS 3,566,056 A * 2/1971 Joseph et al. ..... 200/48 A
5,369,234 A * 11/1994 Demissy ..... 218/14
5,382,764 A * 1/1995 Demissy ..... 218/8
6,936,779 B1 * 8/2005 Rhein et al. ..... 200/48 R
6,946,607 B1 * 9/2005 Roberts ..... 200/48 R

* cited by examiner

*Primary Examiner*—Elvin Enad
*Assistant Examiner*—M. Fishman

(57) ABSTRACT

A switch has a first electrical terminal, a second electrical terminal spaced from the first electrical terminal and an elongate conductive switch blade for bridging the terminals. The switch blade has a first end portion pivotally connected with the first electrical terminal for movement of the switch blade between open and closed positions. The switch blade has a second end portion positioned adjacent the second electrical terminal when in the closed position. A plurality of elongate fingers are secured by spring loading to the second end portion of the switch blade. The fingers are arranged adjacent to each other along opposing sides of the second end portion to form an open jaw structure that extends from the second end portion of the switch blade and makes wiping electrical contact with the second electrical terminal as the switch blade is moved into the closed position.

10 Claims, 5 Drawing Sheets

DISCONNECT SWITCH

FIELD OF THE INVENTION

The present invention relates to a disconnect switch with blades and fingers and in particular a switch suitable for use in three phase non-segregated high current applications.

BACKGROUND OF THE INVENTION

Three phase non-segregated disconnect switches find application in generator compartments for supplying electricity to a power grid. These switches must be capable of withstanding short circuit tests in the order of 80 kA.

One type of disconnect switch used in the three phase non-segregated application comprises a pair of spaced apart elongated blade members which span the distance between first and second electrical terminals of the switch. Typically these spaced apart blades include a spacer between the blades. One end of the blades is pivotally attached to one of the terminals and the other end of the blades has inside edges of the blades making wiping contact with the second electrical terminal. In this switch, as many as three bolts pass through the blades, and springs and nuts are mounted on these bolts so as to control spring loaded compression of the blades with the second electrical terminal. While this spring switch configuration provides a reliable switch for making and breaking the connection at the second electrical terminal, the spring switch does not respond well to 80 kA short circuits in the three phase non-segregated application. During a short circuit, the three phases of the spring switch blades are attracted to each other causing the blades of adjacent phases to be attracted towards each other resulting in at least one of the blades being pulled from the second electrical terminal. This results in arcing and welding of this blade to the second terminal.

Another known construction for a three phase non-segregated disconnect switch is a bolted switch. The bolted switch typically has double switch blades for each phase that carries a bolt that is received within a groove of the second electrical terminal. While the bolted switch is able to withstand the 80 kA short circuit condition, this switch is relatively expensive to manufacture and tends not to be as reliable over time in making and breaking the connection with the second electrical terminal.

BRIEF DESCRIPTION OF THE INVENTION

The present invention relates to a switch comprising a first electrical terminal, a second electrical terminal spaced from the first electrical terminal and an elongate conductive switch blade for bridging the terminals. The switch blade comprises a first end portion pivotally connected with the first electrical terminal for movement of the switch blade between an open position and a closed position. The switch blade comprises a second end portion positioned adjacent the second electrical terminal when the switch blade is in the closed position. A plurality of elongate fingers are secured by spring loading to the second end portion of the switch blade. The plurality of elongate fingers are arranged adjacent to each other along opposing sides of the second end portion of the switch blade to form an open jaw structure that extends from the second end portion of the switch blade and makes wiping electrical contact with the second electrical terminal as the switch blade is moved into the closed position.

In one embodiment, each of the fingers comprises an inside surface comprising first and second spaced apart raised portions. The first raised portion comprises a first flat surface area portion adapted to contact the second end portion of the switch blade and the second raised portion comprises a second flat surface area portion adapted to contact the second electrical terminal when the switch blade is in the closed position. These flat portions on each of the fingers increase the contact surface area between the fingers and the switch blade, and between the fingers and the second terminal connector to thereby improve the short circuit rating of the switch.

In one embodiment the switch blade is a single blade. In an alternative embodiment the switch blade comprises a pair of spaced apart co-extending elongate blade members. The blade members in a preferred embodiment extend parallel to each other.

In one embodiment there is provided a switch comprising a first electrical terminal comprising a first blade like connector portion and a second electrical terminal comprising a second blade like connector portion spaced from the first electrical terminal. The switch further comprises an elongate conductive switch blade for bridging the terminals. The switch blade comprises a pair of spaced apart co-extending elongate blade members, a first end portion and a second end portion. The blade members are pivotally secured to opposing sides of the first blade like connector portion of the first terminal connection at the first end portion of the switch blade for movement of the switch blade between an open position and a closed position. The second end portion of the switch blade is positioned adjacent the second electrical terminal when in the closed position. The second end portion of the switch blade comprises a removable finger end portion comprising a neck portion positioned between and removably secured with the elongate blade members. The finger end portion further comprises a head portion. The switch further comprises a plurality of elongate fingers secured by spring loading to the head portion. The plurality of elongate fingers are arranged adjacent to each other to form two rows of fingers with each row extending along an opposing side of the head portion to form an open jaw structure that extends from the head portion and makes wiping electrical contact with the second blade like connector portion of the second electrical terminal as the switch blade is moved into the closed position.

By utilizing a removable finger end portion, the assembly of the fingers onto the finger end portion is possible prior to assembly of the finger end portion between the blade members resulting in easier assembly. Also, the replacement of the entire finger end portion can be made in the event one or more of the fingers becomes welded to the head portion of the finger end portion without having to replace the blade members.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

Figure 1:
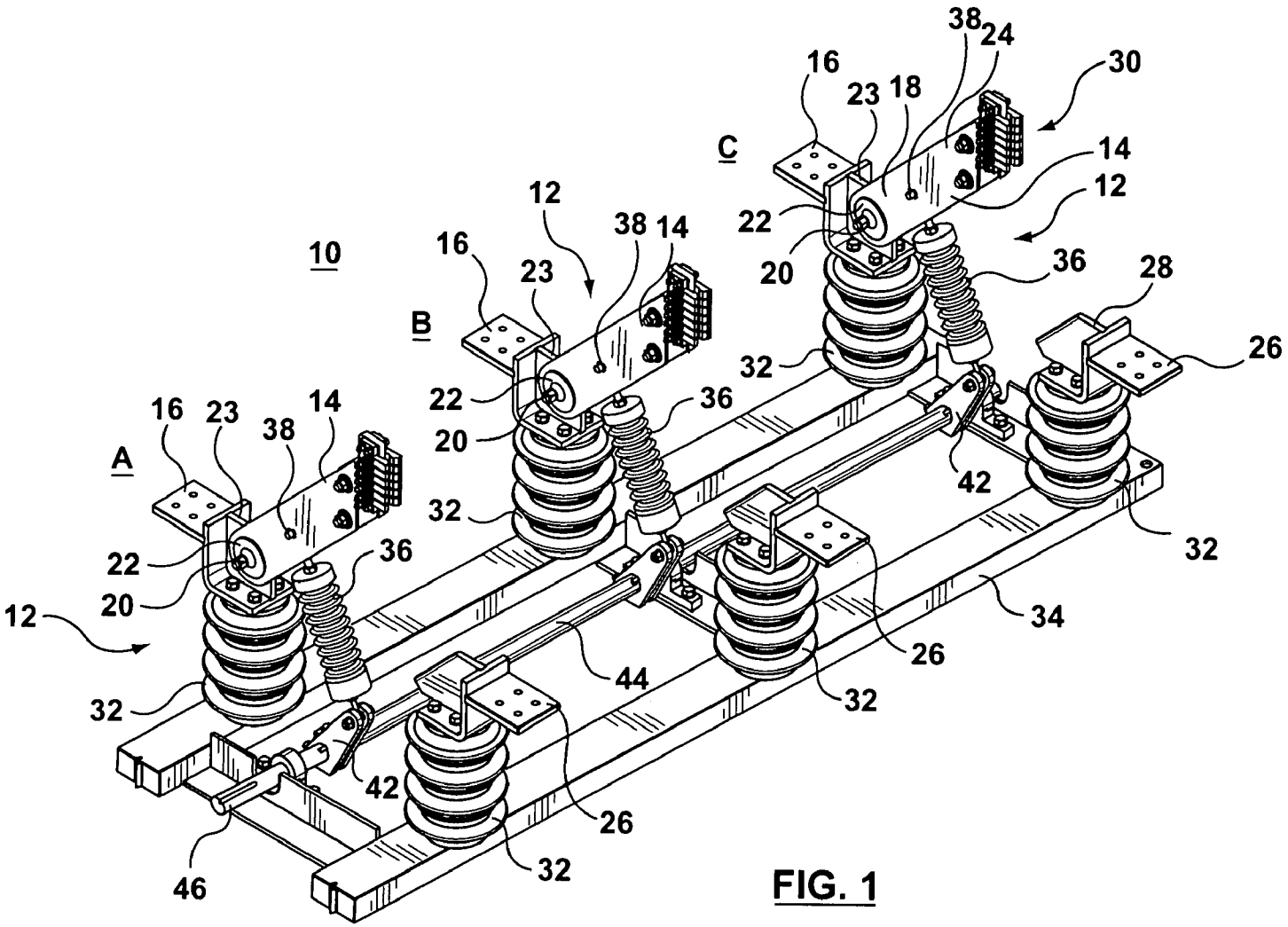
FIG. 1 is a perspective view of a three phase non-segregated disconnect switch of the present invention.

Referring to FIG. 1 there is shown a three phase non-segregated disconnect switch 10. The three phase non-segregated switch 10 comprises three switches 12 for disconnecting power across phases A, B, and C. Typically, these phases are for alternating electrical current that is 120 degrees out of phase with each other.

Figure 2:
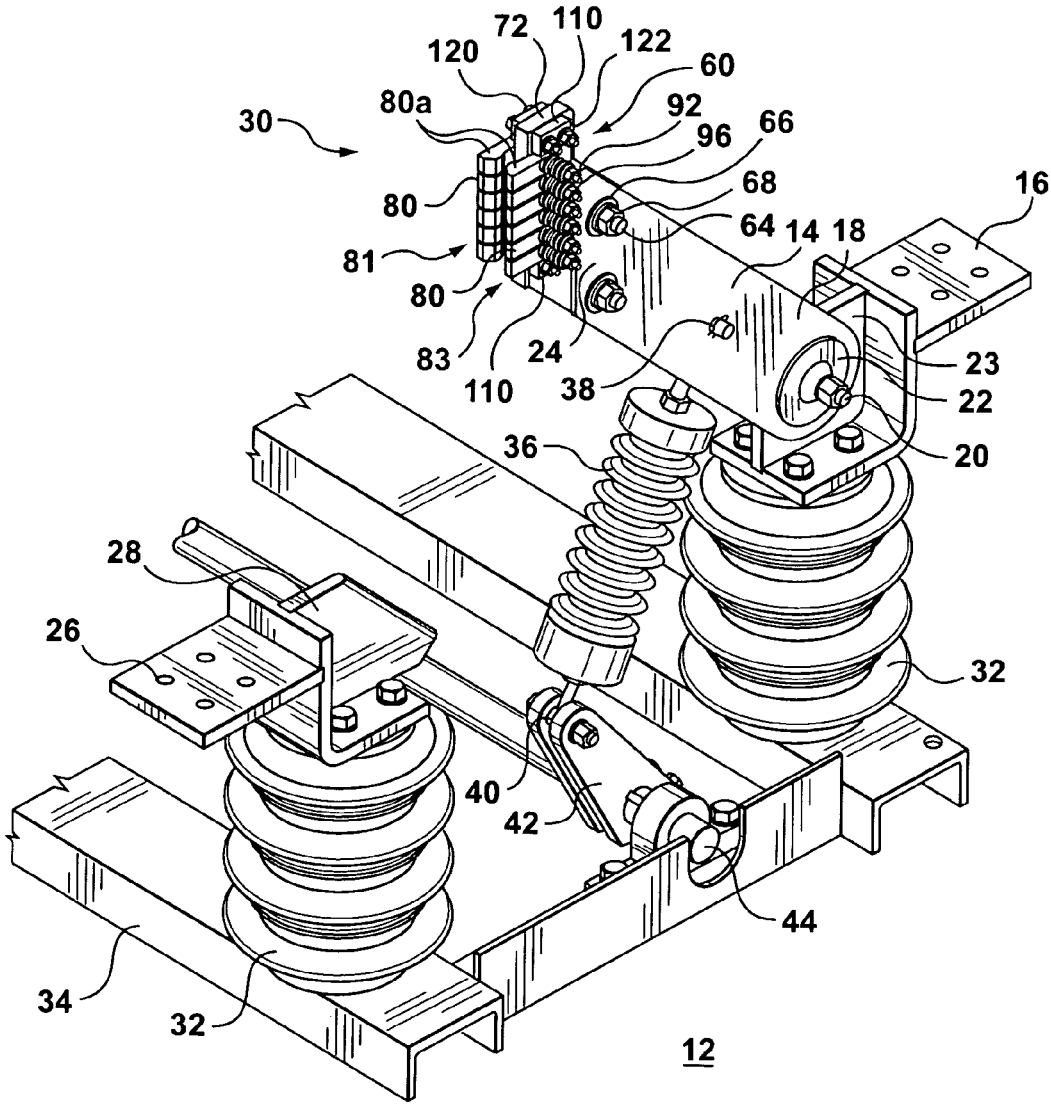
FIG. 2 is an enlarged perspective view of one of the phases of the disconnect switch of the present invention.

Each of the switches 12 comprises an elongate conductive switch blade 14 shown in FIGS. 1 and 2 in the open position. Each of the switches 12 further comprises a first electrical terminal 16 to which a first end portion 18 of the switch blade 14 is pivotally connected by a bolt and nut fastener 20 and a pair of Belleville washers 22 pressing on opposing sides of the first end portion 18 of the blade 14. The first electrical terminal 16 has a blade like connector portion 23 to which the blade 14 is pivotally connected by bolt and nut fastener 20.

Figure 3:
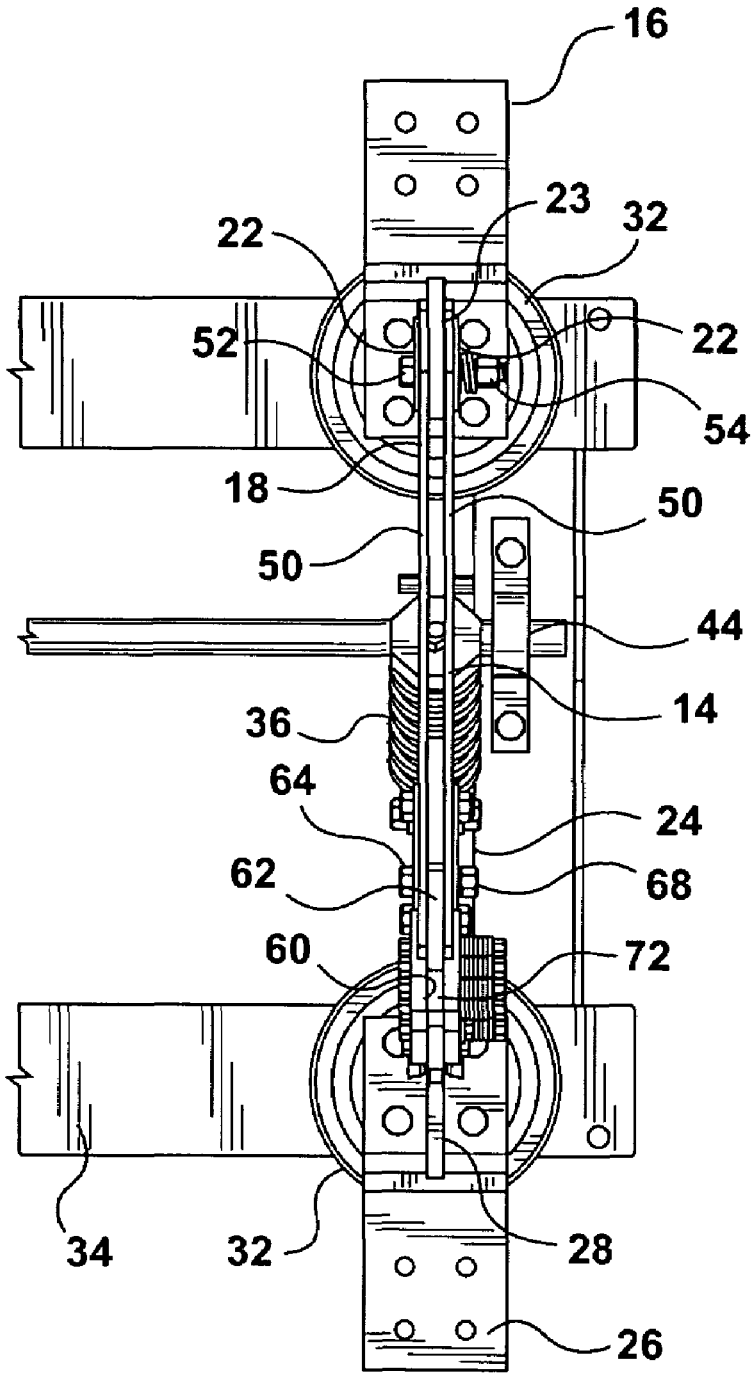
FIG. 3 is a plan view of the switch shown in FIG. 2.

The switch blade 14 has a second end portion 24 which is adapted to bridge the first electrical terminal 16 with the second electrical terminal 26 when the switch blade 14 is in the closed position as shown in FIG. 3. The second electrical terminal 26 comprises a second blade like connector portion 28 against which the jaw 30 of the switch 12 makes wiping electrical contact when in the closed position. Each of the terminals 16 and 26 is mounted through an insulator 32 to a base frame 34 for the three phase non-segregated disconnect switch 10.

Movement of each of the blades 14 is controlled by the insulated linkage 36. The linkage 36 has a first end portion 38 pivotally connected to the switch blade 14 intermediate of, or between, the first end portion 18 and the second end portion 24 of the switch blade 14. The linkage 36 has a second end portion 40 which is pivotally connected to a link arm 42 which in turn is connected for rotation with elongate shaft 44. Shaft 44 has an end 46 which may be connected to a motor (not shown) to effect the rotation of the shaft 46 and thereby effect the rotation and movement of linkage arms 42 and 36 causing the switch blades 14 of each switch 12 to move in unison between the open position shown in FIG. 2 and the closed position shown in FIG. 3.

Figure 4:
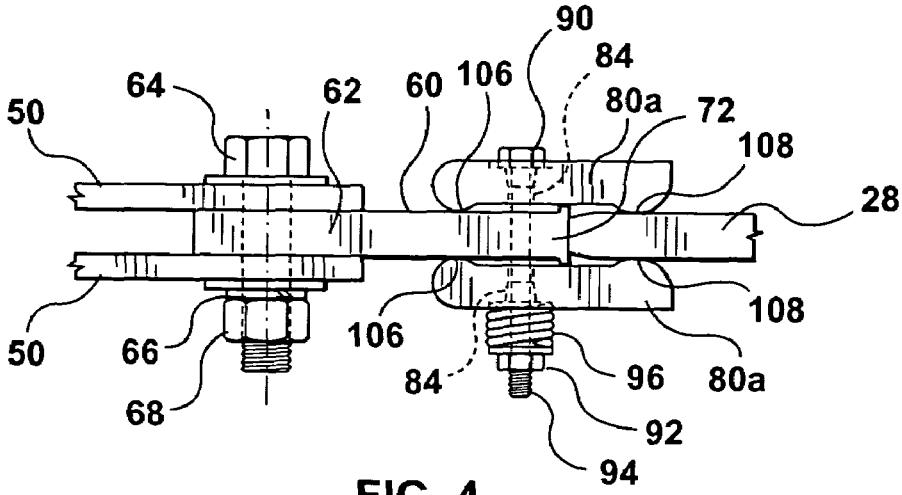
FIG. 4 is a detailed plan view showing the wiping connection of the switch blade of the present invention with one of the second electrical terminals.

Referring to FIGS. 2 to 4, the elongate conductive switch blade 14 in the illustrated embodiment comprises a pair of spaced apart elongate blade members 50 that extend parallel to each other. Each of the blade members 50 is secured at the first end portion 18 to opposing sides of the blade connector portion 23 of the first electrical terminal 16. The electrical and mechanical connection is by maintained the bolt and nut fastener 20 in conjunction with washers 22. The fastener 20 comprises a bolt 52 passing through the blade members 50 and through the blade like connector portion 23. A nut 54 is threadably secured to one end of the bolt 52 and the Belleville washers 22 press the blade members 50 into good electrical contact with the blade like connector portion 23. The blade like connector portion 23 further serves to maintain a predetermined spacing between each of the blades 50.

Figure 5:
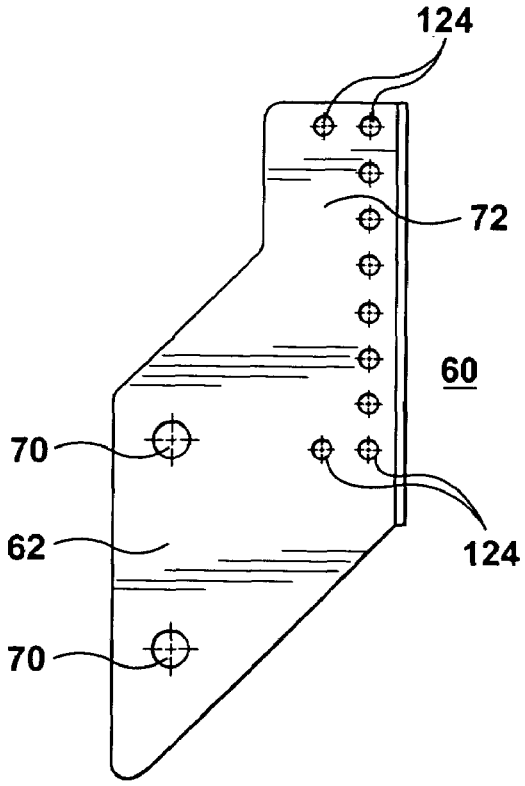
FIG. 5 is a side view of the finger end portion that is removably secured with the blade members of the switch blade of the present invention; and, FIG. 6 is a side plan showing the shape of one of the fingers utilized in the switch of the present invention.

The second end portion 24 of the switch blade 14 comprises a removable finger end portion 60 which is also shown in FIG. 5. The removable finger end portion 60 has a neck portion 62 positioned between and removably secured with the spaced apart elongate blade members 50. The neck portion 62 is removably secured by bolts 64, washers 66 and nuts 68. Bolts 64 pass through the blade members 50 and apertures 70 in the neck portion 62. The neck portion 62 of the removable finger end portion 60 also acts to maintain the spacing between the blade members 50. In the embodiment shown in FIG. 3, the width of the neck portion 62 corresponds to the width of the first blade like connector portion 23 of the first electrical terminal 16 and corresponds to the width of blade like connector portion 28 of terminal 26. Consequently, the co-extending blade members 50 extend parallel to each other.

The first end portion 60 further comprises a head portion 72 to which a plurality of elongated fingers 80 are secured by spring loading. The plurality of elongated fingers 80 are arranged adjacent to each other in rows 81 and 83 (see FIG. 2). The rows 81, 83 extend along opposing sides of the head portion 72. As best seen in FIG. 2, six fingers 80 are mounted adjacent to each other, in contacting relation with each other, in the rows 81, 83 on each side of the head portion 72 to form the open jaw structure 30. It should be understood that while 6 fingers are shown, any appropriate number of fingers may be utilized. Each set of opposing fingers 80*a* is mounted by the use of a bolt 90 passing through apertures 84 (FIG. 4) in the fingers 80 and secured by a nut 92 threadably attached to the bolt end 94. The nut 92 is forced against a compression spring 96 that acts to control the pressure of the opposing fingers of each finger set with the second blade like connector portion 28 of the second terminal 26.

The use of the removable finger end portion 60, removable by removing nuts 68 and bolts 64, permits for the assembly of the fingers 80 on the finger end portion part 60 prior to assembly of part 60 between the blade members 50. Furthermore, in the event that one or more of these fingers 80 welds to the finger end portion 60, then the finger end portion 60 can be removed and readily replaced without having to replace the blade members 50.

Figure 6:
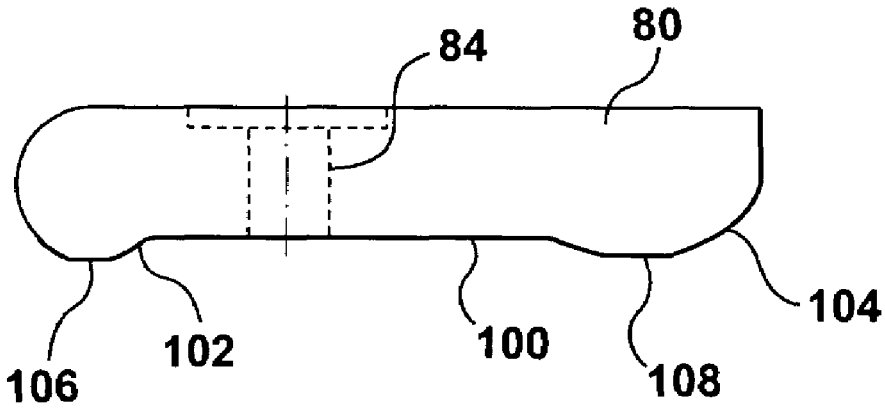

In accordance with another aspect of the present invention, the shape of the fingers 80 is shown in FIG. 6. Each of the fingers 80 comprises an inside surface 100 that has a first raised surface portion 102 and a second raised surface portion 104. The first raised surface portion 102 has a first flat surface area portion 106. The flat surface area portion 106 is adapted to contact the second end portion 24 of the switch blade 14 or in effect the head portion 72 of the removable finger end portion 60. The second raised inside surface area portion 104 of the finger 80 has a second flat surface portion 108 which is adapted to engage the second blade like connector portion 28 of the second terminal 26. The flattened surfaces 106 and 108 respectively of the raised surface portions 102 and 104, increase the surface contact area between the fingers 80 and the blade members 50 and between the fingers 80 and the second blade connector portion 28 of the second electrical terminal 26. This improves the current rating of the switch 12 and its ability to withstand short circuits.

Referring to FIGS. 2 and 5, the switch further includes a pair of stainless steel blocks 110 which are mounted on each side of the second end portion 24 of the switch blade 14 or alternatively referred to as the head portion 72 of the finger end portion 60. These blocks 110 are held in place by two bolts and nuts 120, 122 respectively which pass through apertures 124 in the head portion 72 of the removable finger end portion 60. The use of the two bolts and nuts 120, 122 prevents the blocks 110 from rotating. The blocks 110 are located in juxtaposition with row ends of the fingers 80 and prevent the fingers 80 from shifting relative to the removable finger end portion 60.

In the illustrated embodiment, the first and second electrical terminals, the switch blade members 50 and the fingers 80 are made from silver plated copper. It should be understood that alternative materials known in the art may be used.

While the invention has been described in terms of various specific embodiments, those skilled in the art will recognize that the invention can be practiced with modifications within the spirit and scope of the invention disclosed.

What is claimed is:

1. A switch comprising:

a first electrical terminal;

a second electrical terminal spaced from the first electrical terminal;

an elongate conductive switch blade for bridging the terminals, the switch blade comprising a first end portion pivotally connected with the first electrical terminal for movement of the switch blade between an open position and a closed position, the switch blade comprising a second end portion positioned adjacent the second electrical terminal when the switch blade is in the closed position;

a plurality of elongate fingers secured by spring loading to the second end portion of the switch blade, the plurality of elongate fingers being arranged adjacent to each other along opposing sides of the second end portion of the switch blade to form an open jaw structure that extends from the second end portion of the switch blade and makes wiping electrical contact with the second electrical terminal as the switch blade is moved into the closed position; and, each of the fingers comprising an inside surface comprising first and second spaced apart raised portions, the first raised portion having a first flat surface area portion adapted to contact the second end portion of the switch blade, and the second raised portion having a second flat surface area portion adapted to contact the second electrical terminal when the switch blade is in the closed position.

2. The switch of claim 1 wherein:

the switch blade comprises a pair of spaced apart, co-extending, elongate blade members;

the first electrical terminal comprising a blade like connector end portion on opposing sides of which are pivotally attached the blade members at the first end portion of the switch blade, and, the second end portion of the switch blade comprising a removable finger end portion comprising a neck portion positioned between and removably secured with the blade members, and the finger end portion comprising a head portion to which the elongate fingers are mounted by spring loading.

3. The switch of claim 1 wherein the fingers comprise sets of opposing fingers each mounted to the second end portion by a bolt passing through each set of opposing fingers and the second end portion, compression springs placed over a bolt end portion extending beyond one of the fingers of the set and a nut threadably secured to the bolt end portion to control spring loading of the set of opposing fingers.

4. The switch of claim 2 wherein the fingers comprise sets of opposing fingers each mounted to the head portion by a bolt passing through each set of opposing fingers and the head portion, compression springs placed over a bolt end portion extending beyond one of the fingers of the set and a nut threadably secured to the bolt end portion to control spring loading of the set of opposing fingers.

5. The switch of claim 1 further comprising an insulated linkage pivotally connected with the switch blade between the first and second end portions for moving the switch between the open and closed positions, and wherein the first and second electrical terminals are respectively mounted on first and second insulators.

6. The switch of claim 1 further comprising block members secured to the second end portion on opposing sides thereof and on opposing ends of the fingers to prevent rotation of the fingers relative to the second end portion of the switch blade.

7. A switch comprising:

a first electrical terminal comprising a first blade like connector portion;

a second electrical terminal comprising a second blade like connector portion and being spaced from the first electrical terminal;

an elongate conductive switch blade for bridging the terminals, the switch blade comprising a pair of spaced apart co-extending elongate blade members, the switch blade comprising a first end portion and a second end portion, the blade members being pivotally secured to opposing sides of the first blade like connector portion of the first terminal connection at the first end portion of the switch blade for movement of the switch blade between an open position and a closed position, the second end portion of the switch blade being positioned adjacent the second electrical terminal in the closed position;

the second end portion of the switch blade comprising a removable finger end portion comprising a neck portion positioned between and removably secured with the elongate blade members, and the finger end portion comprising a head portion; and a plurality of elongate fingers secured by spring loading to the head portion, the plurality of elongate fingers being arranged adjacent to each other to form two rows of fingers with each row extending along an opposing side of the head portion to form an open jaw structure that extends from the head portion and makes wiping electrical contact with the second blade like connector portion of the second electrical terminal as the switch blade is moved into the closed position.

8. The switch of claim 7 further comprising block members secured to the second end portion on opposing sides thereof and on opposing ends of the fingers to prevent rotation of the fingers relative to the second end portion of the switch blade.

9. The switch of claim 8 wherein the fingers comprise sets of opposing fingers each mounted to the head portion by a bolt passing through each set of opposing fingers of each set and the head portion, compression springs placed over a bolt end portion extending beyond one of the fingers of each set and a nut threadably secured to the bolt end portion to control spring loading of the set of opposing fingers.

10. The switch of claim 9 further comprising an insulated linkage pivotally connected with the switch blade between the first and second end portions for moving the switch between the open and closed positions and wherein the first and second electrical terminals are respectively mounted on first and second insulators.

* * * * *